US005782526A

United States Patent [19]

Ott

[11] Patent Number: 5,782,526

[45] Date of Patent: Jul. 21, 1998

[54] LEG ASSEMBLY FOR A TABLE

[75] Inventor: David P. Ott, Mosinee, Wis.

[73] Assignee: Wausau Tile, Inc., Wausau, Wis.

[21] Appl. No.: 634,810

[22] Filed: Apr. 19, 1996

[51] Int. Cl.[6] ..... A47B 83/02

[52] U.S. Cl. ..... 297/157.1; 297/158.5; 297/171

[58] Field of Search ..... 297/157.1, 158.3, 297/158.5, 170, 172; 108/157, 159

[56] References Cited

U.S. PATENT DOCUMENTS

D. 242,305 11/1976 Campbell et al. .
D. 242,306 11/1976 Campbell et al. .
681,394 8/1901 Hile .
3,120,405 2/1964 Soszynski .
3,134,625 5/1964 Bliss .
3,348,879 10/1967 Merola .
4,248,477 2/1981 Netters .

*Primary Examiner*—Peter R. Brown
*Assistant Examiner*—Stephen Vu
*Attorney, Agent, or Firm*—Wood, Phillips, VanSanten, Clark & Mortimer

[57] ABSTRACT

A leg assembly for a table having a support assembly made up of upper and lower plates and a plurality of leg sleeves secured to these plates, a plurality of legs are receivable into each of the leg sleeves and extend downwardly from them. Seat posts are secured to the bottom ends of each leg. Each seat post has a seat base and a seat plate mounted thereto. Seats are secured to seat plates on each seat post. A table top is secured to the upper plate of the support assembly. The entire leg assembly is securable to the ground by fastening the seat base to the ground surface. The leg assembly can be shipped in pieces to be assembled on site and is compatible with a variety of table tops and seats.

19 Claims, 3 Drawing Sheets

FIG. 5
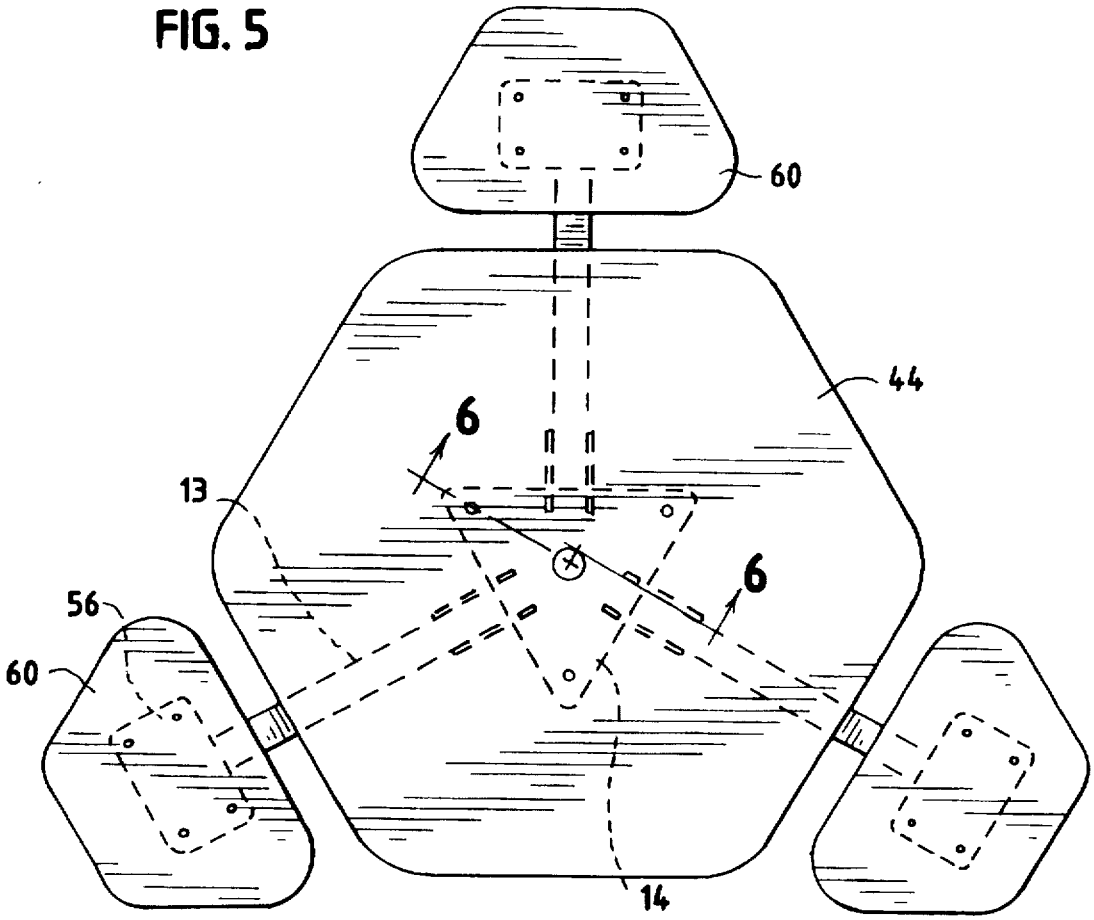
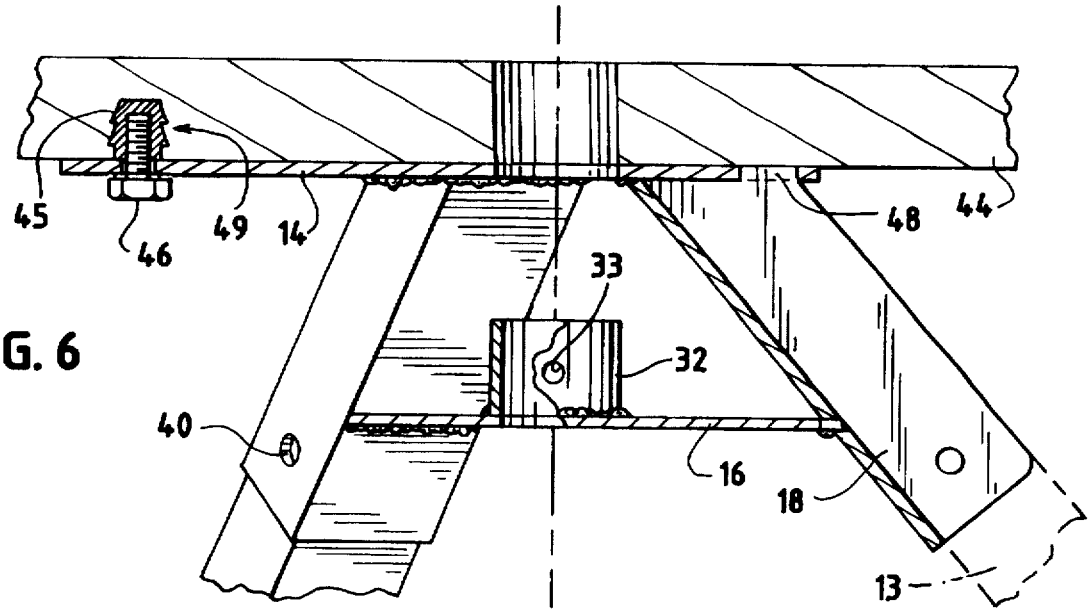
FIG. 6

LEG ASSEMBLY FOR A TABLE

BACKGROUND OF THE INVENTION

The present invention is concerned with a table, and more particularly with an easy-to-assemble, sturdy, recreation table for indoor and outdoor use.

Public parks, resorts, cafeterias, and cafes provide indoor and outdoor seating for their patrons. It is often desirable to provide indoor and outdoor tables in these settings. One requirement of these tables is that they be sturdy. It is further desirable that their construction be versatile enough to work with different types of table tops and seats. Such tables undergo near constant usage and exposure to a wide variety of weather conditions. It is also desirable that the table be shipped in an inexpensive manner. Other desirable features of such tables is that they have minimal assembly requirements, can be securely mounted to the ground surface, and can receive and securely hold a umbrella.

The present invention provides a table having the features discussed above.

SUMMARY OF THE INVENTION

In one aspect of the present invention, a leg assembly for a table has an upper plate and a lower plate that are generally parallel, a number of leg sleeves mounted to the upper and lower plates, and a number of legs received in each of the leg sleeves.

In another aspect of the invention, the leg assembly also comprises a number of seat posts, each attached to a leg and each having a seat base for attachment to a ground surface and a seat plate to which a seat is attached.

In another aspect of the invention, at least three leg sleeves are secured to the upper and lower leg assembly plates. Each leg sleeve receives the upper end of a leg that extends downwardly therefrom. A table surface is also secured to the upper leg assembly plate.

In a further aspect of the invention, a table kit has a leg receiving assembly made up of an upper plate and a lower plate generally parallel to each other with at least three leg sleeves secured to the plates, and legs, one for each sleeve, each leg having an upper end insertable into a leg sleeve.

In a still further aspect of this invention, an umbrella post and umbrella is mountable to a table through holes in the upper and lower plates of the leg assembly.

It is an object of this invention to provide a sturdy, easy to assemble table frame having a minimum number of parts that can be readily secured together.

BRIEF DESCRIPTION OF THE DRAWINGS

FIG. 5 is a plan view of the table; and

FIG. 6 is an enlarged fragmentary, broken section along line 6—6 of FIG. 5.

DESCRIPTION OF THE PREFERRED EMBODIMENT

The preferred embodiment of the table is shown in FIGS. 1–6.

Figure 1:
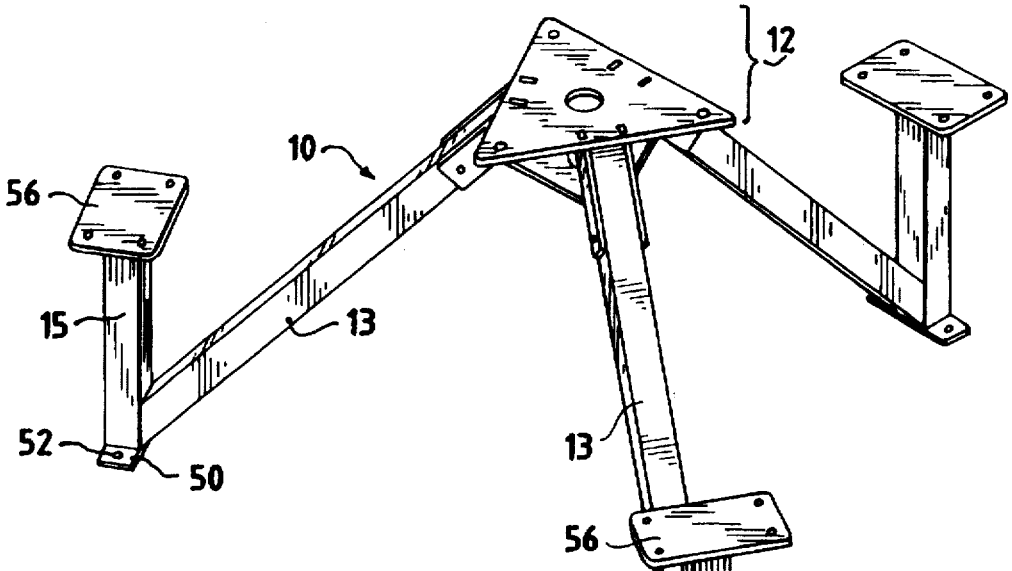
FIG. 1 is a perspective view of the table frame.
Figure 2:
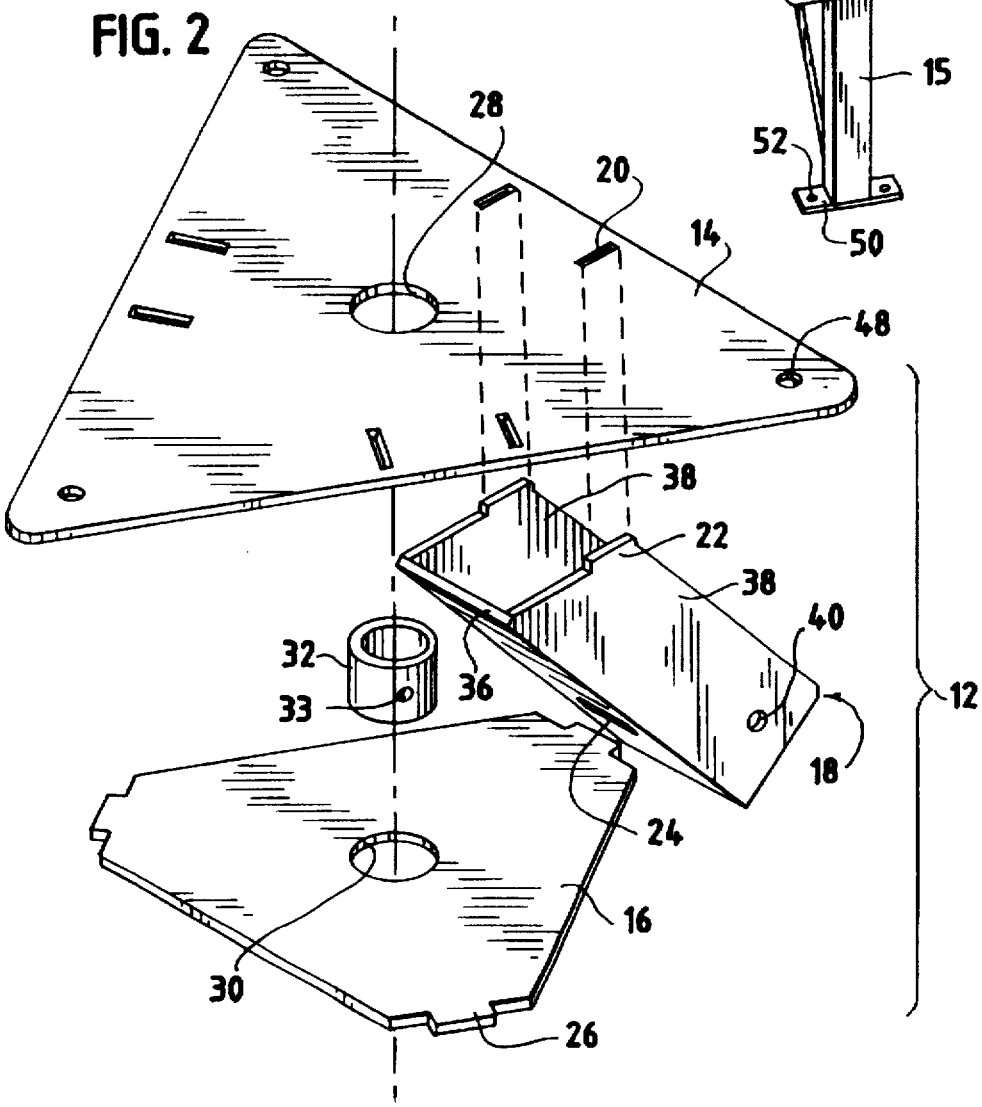
FIG. 2 is an enlarged view of the plate assembly and one leg sleeve.

A leg assembly 10, FIG. 1, is made up of a support assembly 12, a plurality of legs 13 and a corresponding plurality of seat posts 15. The support assembly 12, shown in detail in FIG. 2, has triangular upper and lower plates 14, 16. Leg receiving sleeves 18 join the plates and extend downwardly and outwardly therefrom.

The triangular upper plate 14 of the support assembly 12 has slots 20 forming a first plurality of spaced first connection points located at the mid-points of each upper plate 14 side. These slots 20 correspond to tabs 22 on the upper portion of the leg receiving sleeves 18. Each leg receiving sleeve 18 further contains a sleeve slot 24 which receives a lower plate tab 26. Lower plate tabs 26 appear at the apices of the lower plate and form a second plurality of spaced second connection points. The sleeve tabs 22 are welded in place within the upper plate sleeve slots 20. The welds (not shown) secure the support assembly 12 as a single unit.

Each leg receiving sleeve 18 is in the form of a U-shaped, three-sided channel having a base wall 36 and two opposing side walls 38. Opposing side walls 38 have aligned holes 40. Legs 13 (FIG. 3) have aligned holes 42 which, when aligned with the sleeve holes 40, provide a leg securing passage through which a bolt 41 or other fastener is inserted to lock each leg 13 in each leg receiving sleeve 18.

Figure 3:
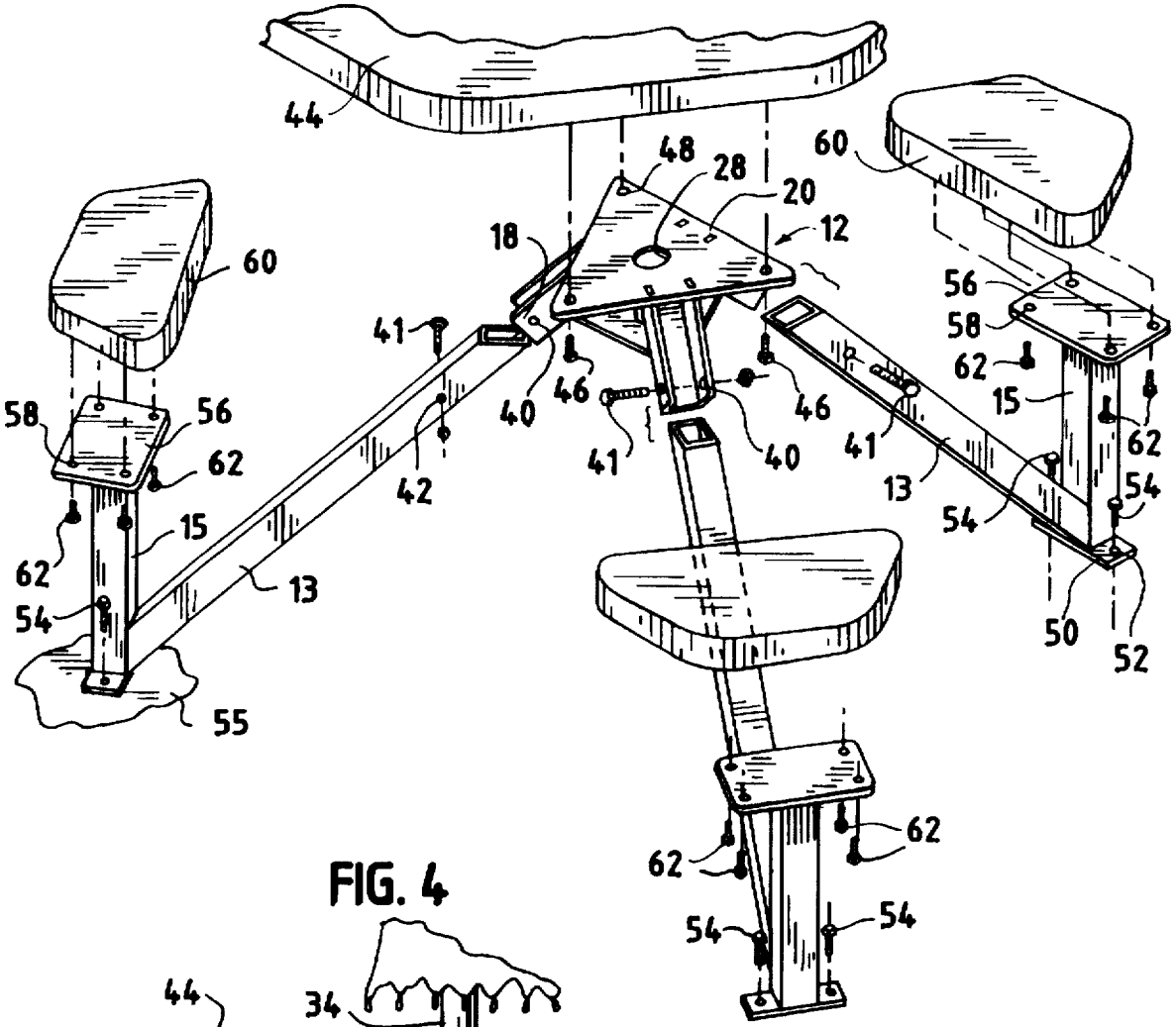
FIG. 3 is a fragmentary, exploded perspective of a table.

Legs 13 have an upper and a lower end as seen in FIG. 3. Seat posts 15 are welded to the lower end of each leg 13. Each seat post 15 is supported by a seat base 50. Each seat base has leg anchoring holes 52 through which mounting bolts 54 are inserted to secure the table frame to the ground surface 55. Each seat post 1 5 has a seat plate 56 welded to its upper end. Seat securing holes 58 exist at the corners of the seat plate 56 to allow a seat 60 to be attached to the seat plate 56. The seat 60 is attached to the seat plate 56 by inserting seat securing fasteners 62 through the seat securing holes 58 into the seat 60.

A table top 44 can be secured for assembly at the upper plate 14 by inserting threaded inserts 45 into the table top 44 in pre-drilled bores 49. The bores 49 are aligned with the table top securing holes 48, which are located at the apices of the upper plate 14. Fasteners 46, preferably hex head cap screws, apices of the upper plate 14. Fasteners 46, preferably hex head cap screws, are then inserted to the table top securing holes 48 to engage the threaded inserts 45, thus securing the table top 44 to the upper plate 14 (FIG. 6).

Figure 4:
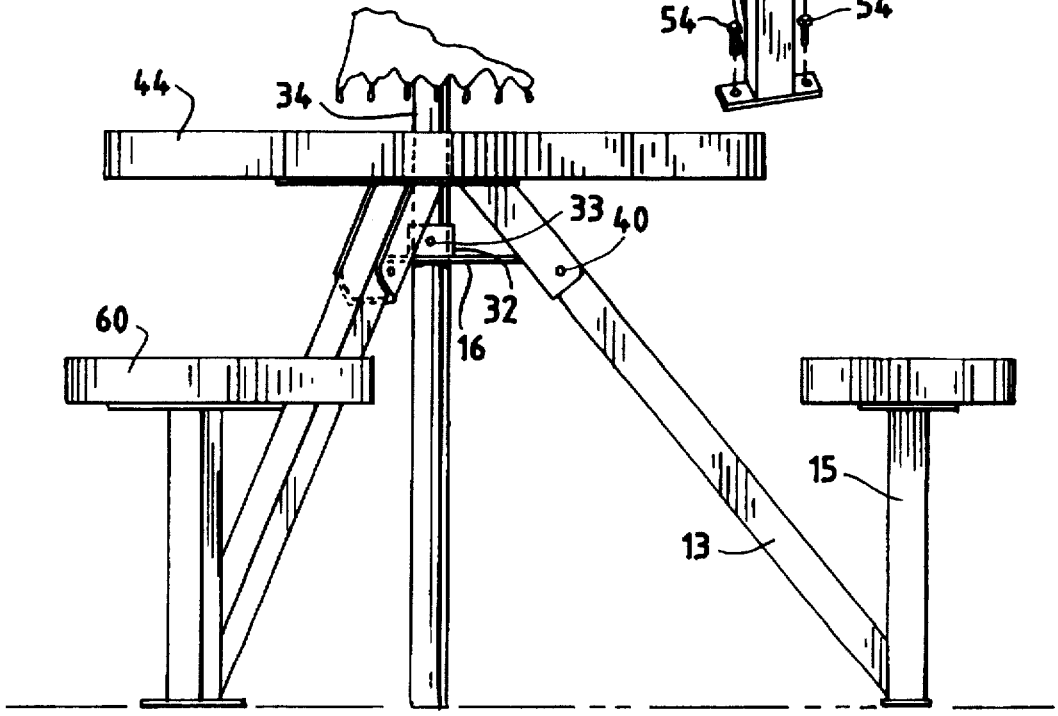
FIG. 4 is a side view of the table.

The upper plate 14 has a hole 28 at its center point and is in alignment with a lower plate hole 30, located at the center of the lower plate 16. The lower plate hole 30 is surrounded by an umbrella sleeve 32 for use with diametric holes 33 in mounting an umbrella 34, as seen in FIG. 4. The umbrella 34 is held upright as it extends through upper plate hole 28, lower plate sleeve 32 and hole 30, and table top hole 45. A fastener 35 is inserted through the sleeve holes 33 to secure the umbrella 34 and to discourage theft.

The above-described sturdy table can be easily assembled on-site without the need for welding or any other heavy-duty assembly process.

The preferred embodiment performs as a sturdy indoor/outdoor table that can be secured to the ground in a reliable manner. The table frame can be used with many different types of table tops and seats, and can be assembled very easily on site. An umbrella can also be secured to this table. Further, the component pieces of the table can be shipped inexpensively for assembly at the installation site.

Still other aspects, objects, and advantages of the present invention can be obtained from a study of the specification, the drawings, and the appended claims.

I claim:

1. A leg assembly for a table, comprising:

an upper plate having a first plurality of spaced first connection points thereon;

a lower plate having a second plurality of spaced second connection points thereon;

a plurality of leg sleeves each secured to the upper and lower plates at one of said first connection points and one of said second connection points forming a leg subassembly with the plates aligned in vertical spaced apart relationship; and a plurality of legs, each having an upper end telescoped with one of the leg sleeves, the legs extending downwardly therefrom.

2. The leg assembly of claim 1 including a plurality of seat posts, each having a seat base and a seat plate wherein each seat post is secured to a leg.

3. The seat post leg assembly of claim 2 including further comprising a seat secured to said seat plate.

4. The leg assembly of claim 1 wherein the leg sleeves extend downwardly and outwardly from the upper and lower plates the legs extending downwardly and outwardly from the leg sleeves.

5. The leg assembly of claim 1 wherein the leg sleeves are U-shaped channels and the legs are tubes which mate with the channels.

6. The leg assembly of claim 5 wherein the leg sleeves extend downwardly and outwardly at an angle on the order of 50° from a horizontal plane.

7. The leg assembly of claim 5 wherein the leg sleeves extend downwardly and outwardly at an angle on the order of 50° from the horizontal.

8. The leg assembly of claim 1 wherein tabs on the upper ends of the leg sleeves are received in slots in the upper plate.

9. A table comprising the leg assembly of claim 1 with a table top secured to said upper plate.

10. A leg assembly for a table, comprising:

an upper plate;

a lower plate;

a plurality of leg sleeves secured to the upper and lower plates forming a leg subassembly with the plates aligned in vertical spaced apart relationship, and a plurality of legs, each having an upper end telescoped with one of the leg sleeves and extending downwardly therefrom, wherein the upper plate is triangular and three leg sleeves are received into slots located at the midpoint of the sides of the triangle.

11. A leg assembly for a table, comprising:

an upper plate; a lower plate;

a plurality of leg sleeves secured to the upper and lower plates forming a leg subassembly with the plates aligned in vertical spaced apart relationship; and a plurality of legs, each having an upper end telescoped with one of the leg sleeves and extending downwardly therefrom, wherein the lower plate is triangular and tabs extending from the apices of the lower plate are received in slots in each sleeve.

12. A table frame kit, comprising:

a leg-receiving subassembly with an upper plate having a first plurality of spaced first connection points thereon, a lower plate having a second plurality of spaced second connection points thereon, and at least three U-shaped leg sleeves, each of the leg sleeves being secured to said plates at one of said first connection points and one of said second connection points with the plates aligned in vertical, spaced apart relationship; and a plurality of legs, one for each leg sleeve, each leg having an upper end telescoped with a leg sleeve.

13. The table frame kit of claim 12 further including a table top secured to said upper plate.

14. The table kit of claim 13 further comprising a plurality of seat posts, each seat post having a seat base and a seat plate, and each seat post being secured to a leg.

15. The table kit of claim 14 further including a seat secured to said seat plate.

16. The table kit of claim 15 further including a seat securable to said seat plate.

17. A table and umbrella, comprising:

a leg assembly having an upper plate, a lower plate, and a plurality of elongate legs each having a cross-sectional area taken transversely to the length thereof and joining the plates and extending downwardly therefrom, the plates being generally parallel, vertically spaced apart and each having a hole therethrough, the holes being vertically aligned, there being no opening in either of the plates to accept the cross-sectional area of the legs;

a table top secured to the upper plate and having a hole therethrough aligned with the holes in the plates; and an umbrella with a post extending downwardly through the holes in the table top and the upper and lower plates.

18. A table and umbrella, comprising:

a leg assembly having an upper plate, a lower plate, and a plurality of legs joining the plates and extending downwardly therefrom, the plates being generally parallel, vertically spaced apart and each having a hole therethrough, the holes being vertically aligned, a table top secured to the upper plate and having a hole therethrough aligned with the holes in the plates, an umbrella with a post extending downwardly through the holes in the table top and the upper and lower plates; and a sleeve on the upper surface of the lower plate and around the hole therein, and a bolt through the sleeve and the umbrella post to retain the umbrella.

19. The table and umbrella of claim 18 having a sleeve on the upper surface of the lower plate and around the hole therein, and a bolt through the sleeve and the umbrella post.

* * * * *